US008393187B2

(12) United States Patent
Bacon

(10) Patent No.: US 8,393,187 B2
(45) Date of Patent: Mar. 12, 2013

(54) REMOTELY OPERATED LOCKING PADDLE HANDLE LATCH ASSEMBLY

(75) Inventor: Bruce C. Bacon, Rockford, MI (US)

(73) Assignee: Bauer Products, Inc., Grand Rapids, MI (US)

( * ) Notice: Subject to any disclaimer, the term of this patent is extended or adjusted under 35 U.S.C. 154(b) by 0 days.

(21) Appl. No.: 13/368,778

(22) Filed: Feb. 8, 2012

(65) Prior Publication Data

US 2012/0174633 A1 Jul. 12, 2012

Related U.S. Application Data

(63) Continuation-in-part of application No. 12/369,516, filed on Dec. 16, 2009, which is a continuation-in-part of application No. 12/952,230, filed on Nov. 23, 2010, now Pat. No. 8,186,191.

(60) Provisional application No. 61/203,403, filed on Dec. 22, 2008, provisional application No. 61/264,935, filed on Nov. 30, 2009, provisional application No. 61/440,895, filed on Feb. 9, 2011.

(51) Int. Cl.
*E05B 59/00* (2006.01)
*E05B 63/14* (2006.01)

(52) U.S. Cl. ..... 70/107; 70/208; 70/210; 70/278.7; 70/279.1; 292/201; 292/216; 292/DIG. 31

(58) Field of Classification Search ..... 70/107–111, 70/208, 210, 278.7, 279.1, 256, 257, 277, 70/283.1; 292/194, 200, 216, DIG. 31, 40, 292/201

See application file for complete search history.

(56) References Cited

U.S. PATENT DOCUMENTS

| | | | |
|---|---|---|---|
| 145,835 | A | 12/1873 | Bissell |
| 374,391 | A | 12/1887 | Born |
| 745,042 | A | 11/1903 | Daves |
| 1,071,567 | A | 8/1913 | Outwater |
| 1,141,463 | A | 6/1915 | Hurd |
| 1,478,381 | A | 12/1923 | Crimmel |
| 1,593,011 | A | 7/1926 | Bourgon |
| 1,596,992 | A | 8/1926 | Ognowicz |
| 1,654,489 | A | 12/1927 | Teich |
| 1,678,498 | A | 7/1928 | Crimmel |

(Continued)

FOREIGN PATENT DOCUMENTS

| | | |
|---|---|---|
| DE | 26 29 332 | 1/1978 |
| GB | 2 123 474 | 2/1984 |

OTHER PUBLICATIONS

TRI/MARK, "Travel Trailer Latch Dead Bolt Option—60-200 Series 60-250 Series," New Hampton, Iowa (date unknown, prior to Jun. 11, 2002).

(Continued)

*Primary Examiner* — Lloyd Gall
(74) *Attorney, Agent, or Firm* — Price Heneveld LLP

(57) ABSTRACT

A locking paddle handle assembly for closures has a housing with a paddle handle pivotally mounted therein, a latch which latches and unlatches the closure upon rotation of the paddle handle, and an exterior key lock with a movable member that shifts between locked and unlocked positions. A deadbolt lock selectively engages the closure frame in the locked position to positively retain the closure closed. The deadbolt lock is operably connected with the movable key lock member, such that movement of the latter between the latched and unlatched positions contemporaneously shifts the deadbolt lock between the locked and unlocked positions. A remotely operable controller may be mounted either horizontally or vertically relative the handle assembly and is operably connected to a multi-armed lock cam to power shift the deadbolt lock between the locked and unlocked positions from a remote location.

13 Claims, 9 Drawing Sheets

U.S. PATENT DOCUMENTS

| | | | |
|---|---|---|---|
| 1,805,891 | A | 5/1931 | Shinn |
| 1,807,804 | A | 6/1931 | Stone |
| 1,845,732 | A | 2/1932 | Tournier et al. |
| 1,964,066 | A | 6/1934 | Kaszmaul |
| 2,022,718 | A | 12/1935 | Heins |
| 2,097,407 | A | 10/1937 | Spinello |
| 2,112,372 | A | 3/1938 | Lofgren |
| 2,201,957 | A | 5/1940 | North |
| 2,202,056 | A | 5/1940 | Kandetzki |
| 2,241,785 | A | 5/1941 | Lofgren |
| 2,253,547 | A | 8/1941 | Adams |
| 2,263,180 | A | 11/1941 | Lofgren |
| 2,303,624 | A | 12/1942 | Edwards et al. |
| 2,322,948 | A | 6/1943 | Lofgren |
| 2,324,406 | A | 7/1943 | Lofgren et al. |
| 2,460,709 | A | 2/1949 | Navarro |
| 2,642,300 | A | 6/1953 | Pelcin |
| 2,668,076 | A | 2/1954 | Troche et al. |
| 2,735,706 | A | 2/1956 | Pelcin |
| 2,871,048 | A | 1/1959 | Balogh |
| 2,900,204 | A | 8/1959 | Pelcin |
| 2,987,908 | A | 6/1961 | Pelcin |
| 3,019,632 | A | 2/1962 | Russell |
| 3,027,188 | A | 3/1962 | Eickstadt |
| 3,080,743 | A | 3/1963 | Stansberry |
| 3,095,726 | A | 7/1963 | Schlage |
| 3,111,833 | A | 11/1963 | Dettmer |
| 3,190,093 | A | 6/1965 | Schlage |
| 3,234,765 | A | 2/1966 | Kerr |
| 3,283,549 | A | 11/1966 | Mees |
| 3,438,227 | A | 4/1969 | Wolniak |
| 3,514,979 | A | 6/1970 | Wiesmann |
| D218,672 | S | 9/1970 | Lauper |
| 3,563,071 | A | 2/1971 | Barger |
| 3,580,016 | A | 5/1971 | Kerr |
| 3,668,907 | A | 6/1972 | Pastva, Jr. |
| 3,707,862 | A | 1/1973 | Pastva, Jr. |
| D230,132 | S | 1/1974 | Pastva, Jr. |
| 3,782,141 | A | 1/1974 | Doerrfeld |
| 3,789,550 | A | 2/1974 | Seiwert |
| 3,998,080 | A | 12/1976 | Fane |
| 4,045,064 | A | 8/1977 | Okada |
| 4,052,092 | A | 10/1977 | Bergen |
| 4,075,879 | A | 2/1978 | Christopher |
| 4,138,869 | A | 2/1979 | Pelcin |
| 4,158,299 | A | 6/1979 | Grabner et al. |
| 4,237,709 | A | 12/1980 | Krugener et al. |
| 4,276,760 | A | 7/1981 | Nolin |
| 4,309,884 | A | 1/1982 | Davis |
| 4,312,197 | A | 1/1982 | Carrion et al. |
| 4,312,202 | A | 1/1982 | Pastva, Jr. et al. |
| 4,413,493 | A | 11/1983 | Meinsen et al. |
| 4,418,552 | A | 12/1983 | Nolin |
| 4,420,954 | A | 12/1983 | Hieronymi et al. |
| 4,438,964 | A | 3/1984 | Peters |
| 4,443,032 | A | 4/1984 | Bonassi |
| 4,474,393 | A | 10/1984 | Kimura |
| 4,508,379 | A | 4/1985 | Mochida |
| D281,665 | S | 12/1985 | Winderman et al. |
| 4,630,457 | A | 12/1986 | Kincaid et al. |
| 4,653,143 | A | 3/1987 | Ketelhut et al. |
| 4,677,834 | A | 7/1987 | Hicks |
| 4,689,976 | A | 9/1987 | Larsen |
| 4,715,201 | A | 12/1987 | Craig |
| 4,725,085 | A | 2/1988 | Hu et al. |
| 4,732,417 | A | 3/1988 | Yang |
| 4,762,348 | A | 8/1988 | Matsumoto |
| 4,773,683 | A | 9/1988 | Nakamura |
| 4,778,206 | A | 10/1988 | Matsumoto et al. |
| 4,821,539 | A | 4/1989 | Steinbach |
| 4,850,209 | A | 7/1989 | Weinerman et al. |
| D303,617 | S | 9/1989 | Russell et al. |
| D303,618 | S | 9/1989 | Russell et al. |
| D303,621 | S | 9/1989 | Russell et al. |
| D303,922 | S | 10/1989 | Russell et al. |
| D304,155 | S | 10/1989 | Russell et al. |
| 4,892,338 | A | 1/1990 | Weinerman et al. |
| 4,934,800 | A | 6/1990 | Choi |
| 4,936,122 | A | 6/1990 | Osada |
| 4,966,018 | A | 10/1990 | Hauber |
| 4,976,123 | A | 12/1990 | Ceron et al. |
| D314,131 | S | 1/1991 | Russell et al. |
| 4,986,576 | A | 1/1991 | Anderson |
| 5,027,625 | A | 7/1991 | Krachten |
| 5,042,853 | A | 8/1991 | Gleason et al. |
| 5,058,937 | A | 10/1991 | Miehe et al. |
| 5,060,991 | A | 10/1991 | Davidian et al. |
| 5,074,009 | A | 12/1991 | Simonton et al. |
| 5,119,654 | A | 6/1992 | Ceron et al. |
| 5,127,686 | A | 7/1992 | Gleason et al. |
| 5,174,456 | A | 12/1992 | Grody |
| 5,180,201 | A | 1/1993 | Hauber |
| 5,182,929 | A | 2/1993 | Myers |
| D339,050 | S | 9/1993 | Gleason et al. |
| 5,265,453 | A | 11/1993 | Konii |
| 5,265,920 | A | 11/1993 | Kaup et al. |
| 5,299,844 | A | 4/1994 | Gleason |
| 5,301,989 | A | 4/1994 | Dallmann et al. |
| D346,731 | S | 5/1994 | Larsen et al. |
| 5,484,178 | A | 1/1996 | Sandhu et al. |
| D369,084 | S | 4/1996 | McConnell et al. |
| D371,500 | S | 7/1996 | McConnell et al. |
| 5,531,498 | A | 7/1996 | Kowall |
| D373,298 | S | 9/1996 | Miehe et al. |
| 5,564,295 | A | 10/1996 | Weinerman et al. |
| 5,586,459 | A | 12/1996 | Bullock et al. |
| 5,586,795 | A | 12/1996 | Sasaki |
| 5,595,076 | A | 1/1997 | Weinerman et al. |
| 5,606,882 | A | 3/1997 | Larsen et al. |
| 5,611,227 | A | 3/1997 | Solovieff |
| 5,711,506 | A | 1/1998 | Stillwagon |
| D390,086 | S | 2/1998 | Weinerman et al. |
| D394,373 | S | 5/1998 | Weinerman et al. |
| 5,775,146 | A | 7/1998 | Edwards et al. |
| 5,799,520 | A | 9/1998 | Laabs et al. |
| 5,875,948 | A | 3/1999 | Sadler |
| 5,884,948 | A | 3/1999 | Weinerman et al. |
| 5,927,773 | A * | 7/1999 | Larsen et al. ..... 292/337 |
| 5,964,110 | A | 10/1999 | Crocco et al. |
| 5,975,597 | A | 11/1999 | Makiuchi et al. |
| 6,042,159 | A | 3/2000 | Spitzley |
| 6,059,329 | A | 5/2000 | Spitzley |
| 6,101,853 | A | 8/2000 | Herr |
| 6,108,979 | A | 8/2000 | Saffran et al. |
| 6,138,883 | A | 10/2000 | Jackson |
| 6,203,086 | B1 | 3/2001 | Dirks |
| D440,481 | S | 4/2001 | Bacon |
| 6,220,649 | B1 | 4/2001 | Rife |
| 6,257,030 | B1 | 7/2001 | Davis |
| 6,309,008 | B1 | 10/2001 | Bacon |
| 6,363,577 | B1 | 4/2002 | Spitzley |
| 6,382,006 | B1 | 5/2002 | Field et al. |
| 6,409,234 | B1 | 6/2002 | Larsen et al. |
| 6,513,353 | B1 | 2/2003 | Weinerman et al. |
| 6,604,393 | B2 | 8/2003 | Larsen et al. |
| 6,629,441 | B2 | 10/2003 | Lavergne |
| 6,651,467 | B1 | 11/2003 | Weinerman et al. |
| D485,155 | S | 1/2004 | Bacon |
| 6,685,240 | B2 | 2/2004 | Bacon |
| 6,701,761 | B1 | 3/2004 | Chang et al. |
| 6,708,537 | B1 | 3/2004 | Eschweiler et al. |
| 6,758,503 | B2 | 7/2004 | Sadler |
| 6,845,641 | B2 | 1/2005 | Hsieh |
| 6,854,304 | B2 | 2/2005 | Linares |
| 6,857,298 | B2 | 2/2005 | Linares |
| 6,962,375 | B2 | 11/2005 | Linares |
| 7,028,514 | B2 | 4/2006 | Banks |
| 7,034,655 | B2 | 4/2006 | Magner et al. |
| 7,070,216 | B2 | 7/2006 | von zur Muehlen |
| 7,097,216 | B2 | 8/2006 | Lane |
| D529,367 | S | 10/2006 | Zweibohmer et al. |
| 7,119,709 | B2 | 10/2006 | Magner et al. |
| 7,155,946 | B2 | 1/2007 | Lee et al. |
| 7,168,755 | B2 | 1/2007 | Munezane |
| 7,237,812 | B2 | 7/2007 | Tweedy |
| 7,363,786 | B2 | 4/2008 | Terhaar et al. |
| 7,401,484 | B1 | 7/2008 | Holmes et al. |

| | | | | |
|---|---|---|---|---|
| 7,520,152 | B2 | 4/2009 | Sabo et al. | |
| 7,819,444 | B2 | 10/2010 | Kagawa et al. | |
| 8,186,191 | B2 * | 5/2012 | Bacon | 70/208 |
| 2003/0010073 | A1 | 1/2003 | Larsen et al. | |
| 2003/0226384 | A1 | 12/2003 | Shedd et al. | |
| 2004/0074269 | A1 | 4/2004 | Lee | |
| 2006/0049647 | A1 | 3/2006 | von zur Muehlen | |
| 2006/0260203 | A1 | 11/2006 | Wong et al. | |
| 2007/0001479 | A1 | 1/2007 | Fukuda et al. | |
| 2007/0056338 | A1 | 3/2007 | Sabo et al. | |
| 2007/0163312 | A1 | 7/2007 | Shen | |
| 2008/0258867 | A1 | 10/2008 | Harris et al. | |
| 2010/0300162 | A1 | 12/2010 | Cappuccio et al. | |
| 2010/0321173 | A1 | 12/2010 | Magner et al. | |

OTHER PUBLICATIONS

TRI/MARK, "Tri/Mark Designers & Manufacturers of Vehicle Hardware Products," New Hampton, Iowa (1996).

* cited by examiner

REMOTELY OPERATED LOCKING PADDLE HANDLE LATCH ASSEMBLY

CROSS-REFERENCE TO RELATED APPLICATIONS AND CLAIM TO PRIORITY

This application is a continuation-in-part of and claims priority under 35 U.S.C. §120 to commonly assigned, co-pending, related U.S. patent application Ser. No. 12/639,516, filed Dec. 16, 2009, entitled LOCKING PADDLE HANDLE LATCH ASSEMBLY FOR CLOSURES AND THE LIKE, which claimed priority under 35 U.S.C. §119(e) to U.S. Provisional Application Ser. No. 61/203,403, filed Dec. 22, 2008; and further is a continuation-in-part of and claims priority under 35 U.S.C. §120 to commonly assigned, related U.S. patent application Ser. No. 12/952,230, filed Nov. 23, 2010, now U.S. Pat. No. 8,186,191, issued May 29, 2012, entitled REMOTELY OPERATED LOCKING PADDLE HANDLE LATCH ASSEMBLY FOR CLOSURES AND THE LIKE, which claimed priority under 35 U.S.C. §119(e) to provisional U.S. Patent Application Ser. No. 61/264,935, filed Nov. 30, 2009, the entire disclosures of which are incorporated herein by reference. This application also claims priority under 35 U.S.C. §119(e) of U.S. Provisional Application Ser. No. 61/440,895, filed Feb. 9, 2011, the entire disclosure of which is incorporated herein by reference.

BACKGROUND OF THE INVENTION

The present invention relates to latches for movable closures and the like, and, in particular, to a remotely operated locking paddle handle latch assembly.

Paddle handles are generally well known in the art, and are typically flush mounted on an associated closure or door to facilitate selectively shifting the closure between an open unlatched position and closed latched position. Paddle handle assemblies are used widely on entry doors for recreational vehicles, motor homes and the like, and in such applications, require that the latch mechanism be accessible and operable from both the inside and the outside of the vehicle, and that they include a deadbolt lock for maximum security.

Heretofore, paddle handle assemblies have proven generally effective, although they experience certain drawbacks. For example, such prior art paddle handle assemblies are not particularly adapted for use with remotely operated power actuators, which have become quite popular in the recreational vehicle industry. Hence, a paddle handle assembly which overcomes such drawbacks would be advantageous.

SUMMARY OF THE INVENTION

One aspect of the present invention is a remotely operated locking paddle handle assembly for closures and the like having a housing adapted for mounting in or adjacent an associated closure of the type that can be shifted between an open position and a closed position. A paddle handle is pivotally mounted in an interior portion of the housing for rotation between a retracted position and an extended position. A latch is operably connected with the paddle handle, and configured such that when the paddle handle is in the retracted position, the latch is in the latched position, wherein the closure cannot be unintentionally shifted from the closed position, and when the paddle handle is in the extended position, the latch is in an unlatched position, wherein the closure is free to be shifted from the closed position to the open position. A key lock is mounted on an exterior portion of the housing, and includes a movable key lock member that is selectively moveable between a locked position and an unlocked position. A deadbolt lock is movably mounted in the housing for shifting between a locked position, wherein the closure is positively retained in the closed position, and an unlocked position, wherein the closure is free to be shifted between the open position and closed position. The deadbolt lock is operably connected with the movable key lock member, whereby movement of the movable key lock member between the locked and unlocked positions shifts the deadbolt lock between the locked and unlocked positions. A remotely operated controller is operably connected with the deadbolt lock through a multi-arm lock cam having a first crank arm operably connected with the deadbolt lock and second and third crank arms. The multi-arm lock cam is rotatably mounted in the housing and operably connected with the key lock member for rotation therewith. The remotely operable controller, which may be mounted horizontally or vertically via either of the second or third crank arms relative and proximate the remotely operated locking paddle handle latch assembly, shifts the deadbolt lock between the locked and unlocked positions from a remote location when activated.

Another aspect of the present invention is a remotely operated paddle handle assembly that has an uncomplicated design which is efficient in use, economical to manufacture, capable of a long operating life, and particularly well adapted for the proposed use.

A further aspect of the present invention is a remotely operated locking paddle handle latch assembly that is adapted for a variety of mounting configurations and applications.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
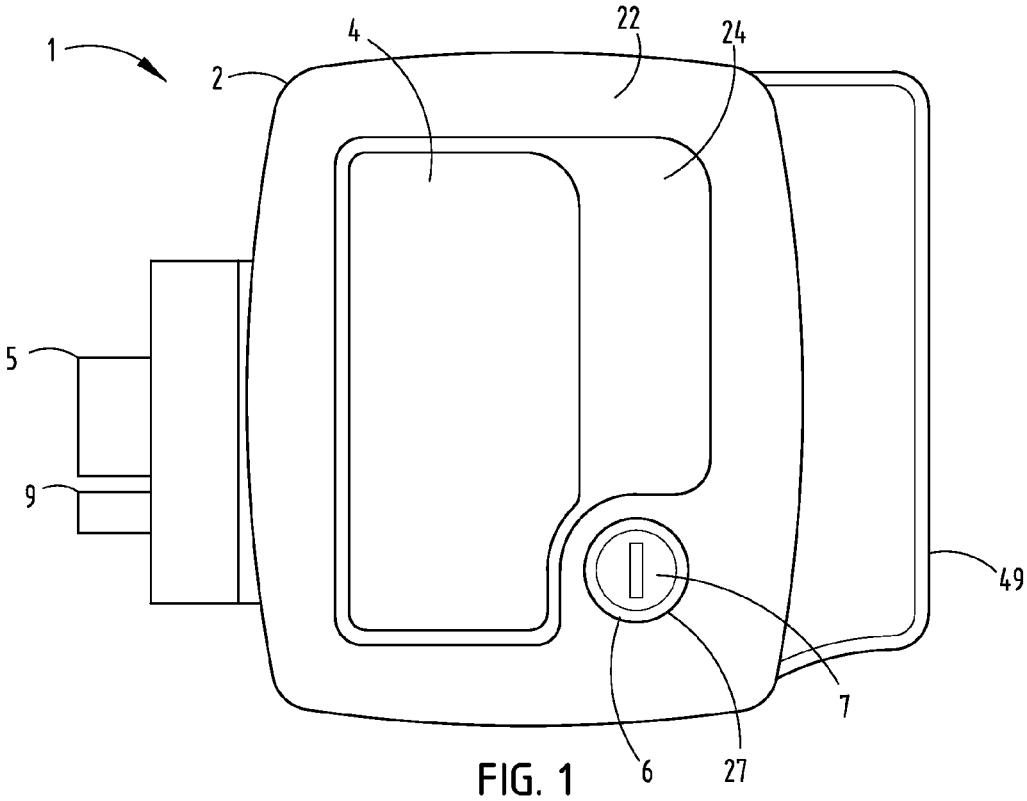
FIG. 1 is a front elevational view of a remotely operated locking paddle handle latch assembly embodying the present invention.
Figure 2:
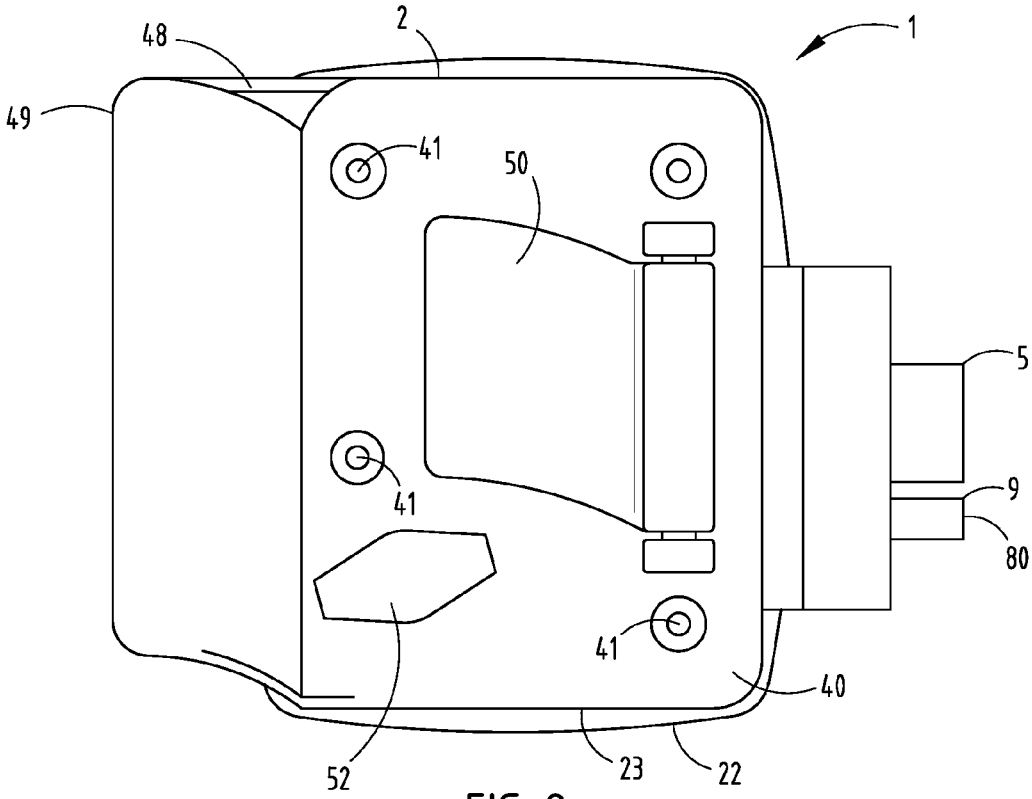
FIG. 2 is a rear elevational view of the paddle handle latch assembly.
Figure 3:
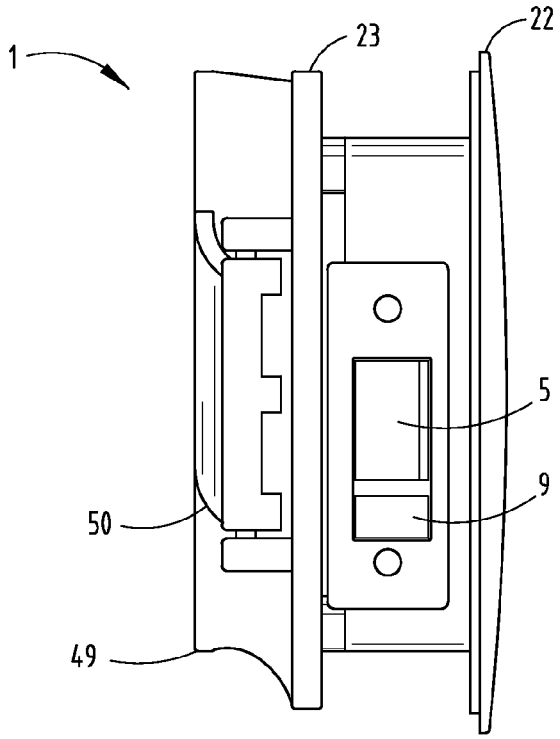
FIG. 3 is a left-hand side elevational view of the lockable paddle handle latch assembly.
Figure 4:
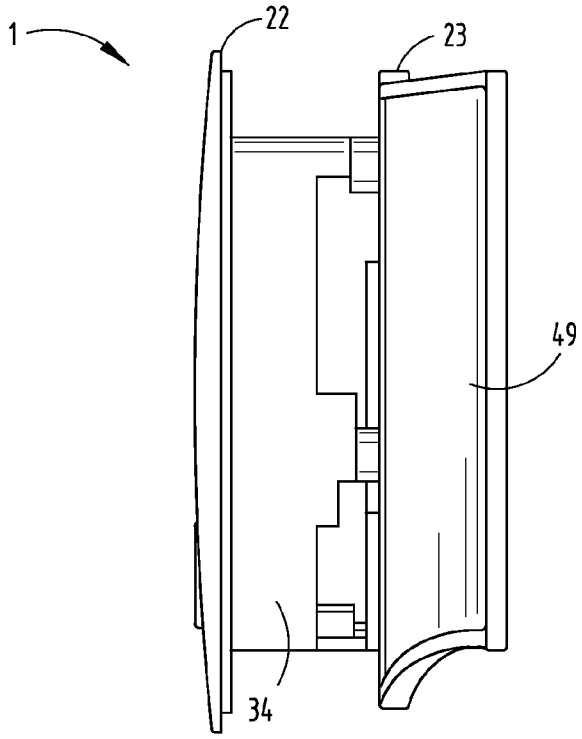
FIG. 4 is a right-hand side elevational view of the lockable paddle handle latch assembly.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11:
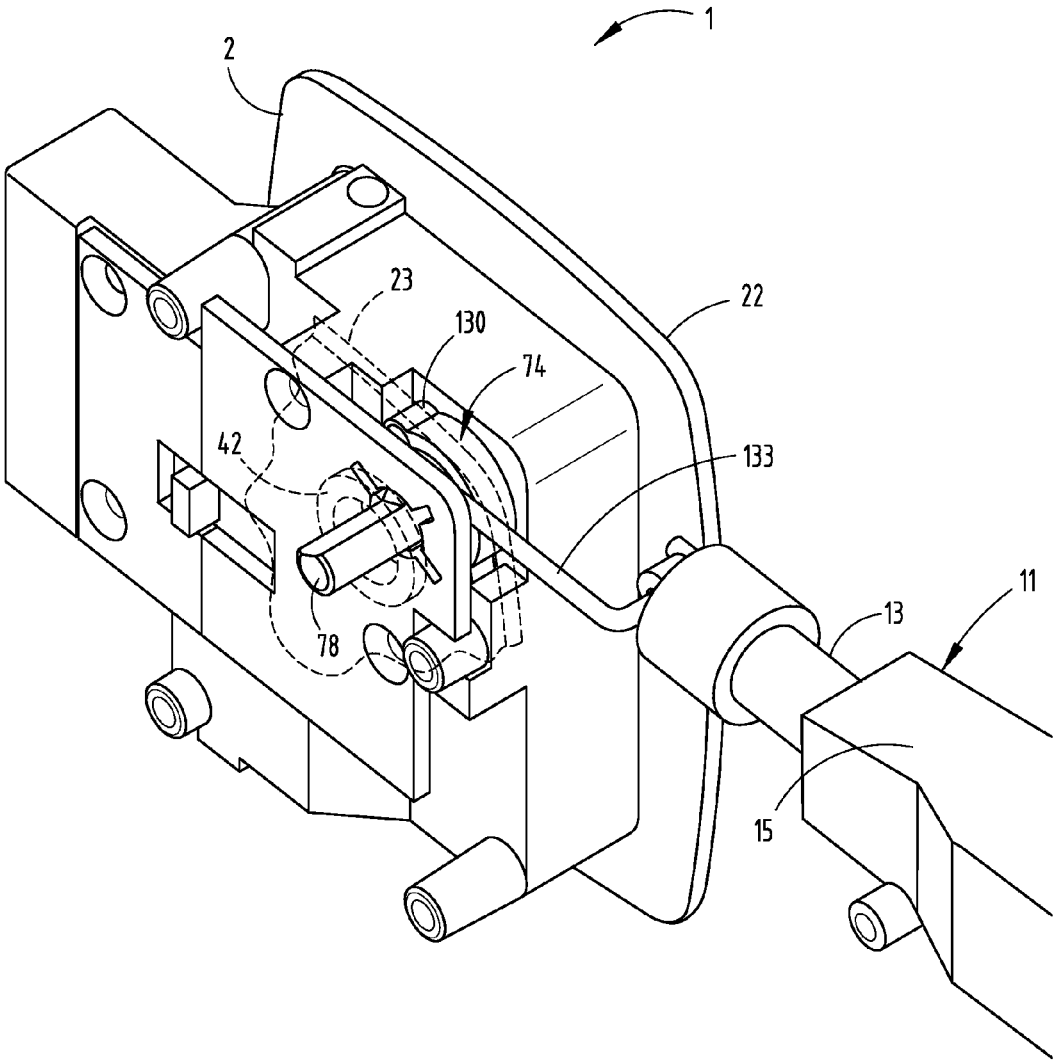
FIG. 11 is a perspective view of the paddle handle latch assembly shown with an associated remotely operated controller.

The reference numeral 1 (FIGS. 1-4) generally designates a remotely operated locking paddle handle latch assembly embodying the present invention. Locking paddle handle latch assembly 1 includes a housing 2 adapted for mounting in or adjacent to an associated closure of the type that can be shifted between an open position and a closed position. A paddle handle 4 is pivotally mounted in an interior portion of housing 2 for rotation between a retracted position and an extended position. A latch 5 is operably connected with paddle handle 4, and configured such that when paddle handle 4 is in the retracted position, latch 5 is in a latched position, wherein the closure cannot be unintentionally shifted from the closed position, and such that when paddle handle 4 is in the extended position, latch 5 is in an unlatched position, wherein the closure is free to be shifted from the closed position to the open position. A key lock 6 is mounted on an exterior portion of housing 2, and includes a movable key lock member 7 that is selectively movable between a locked position and an unlocked position. A deadbolt lock 9 is mounted in housing 2 for shifting between a locked position, wherein the closure is positively retained in the closed position, and an unlocked position, wherein the closure is free to be shifted between the open and closed positions. Deadbolt lock 9 is operably connected with movable key lock member 7, such that movement of the movable key lock member 7 between the locked and unlocked positions shifts the deadbolt lock 9 between the locked and unlocked positions. A remotely operated controller 11 (FIGS. 11 and 12) reciprocates between locked and unlocked positions, and is operably connected with deadbolt lock 9 to shift the same between the locked and unlocked positions from a remote location.

As best illustrated in FIGS. 1-5, the illustrated housing 2 has a two-part construction, comprising an exterior plate 22 in which paddle handle 4 is pivotally mounted, and an interior plate 23 which mounts on the interior of the closure and is attached to exterior plate 22 by fasteners. The illustrated exterior plate 22 includes a centrally disposed, bowl-shaped recess 24 located directly behind paddle handle 4 which provides finger access to facilitate rotation of paddle handle 4 between the retracted and extended positions. The bottom wall of recess 24 includes an actuator window through which an actuator tab on paddle handle 4 extends to operate latch 5. The marginal portion of exterior plate 22 includes a lock aperture 27 in which key lock 6 is mounted.

Figure 5:
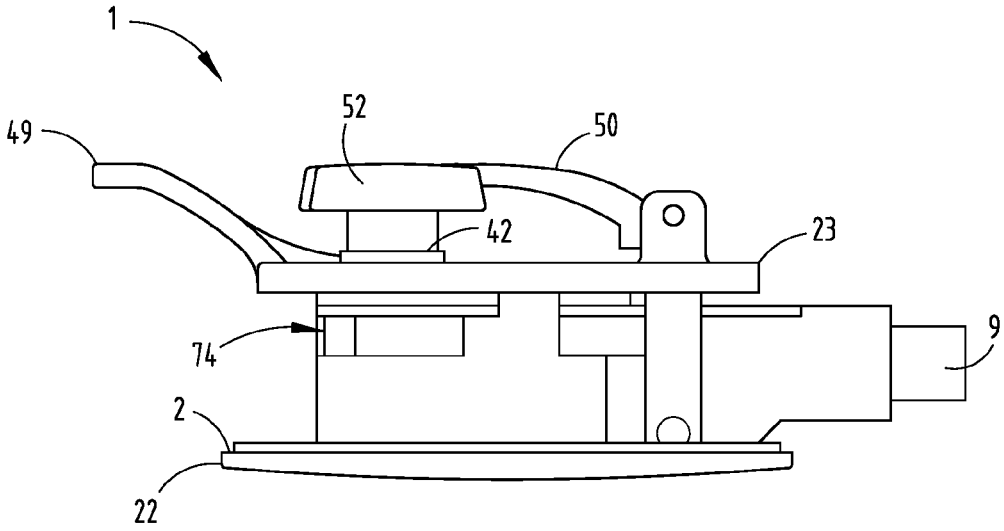
FIG. 5 is a bottom elevational view of the lockable paddle handle latch assembly.
Figure 6:
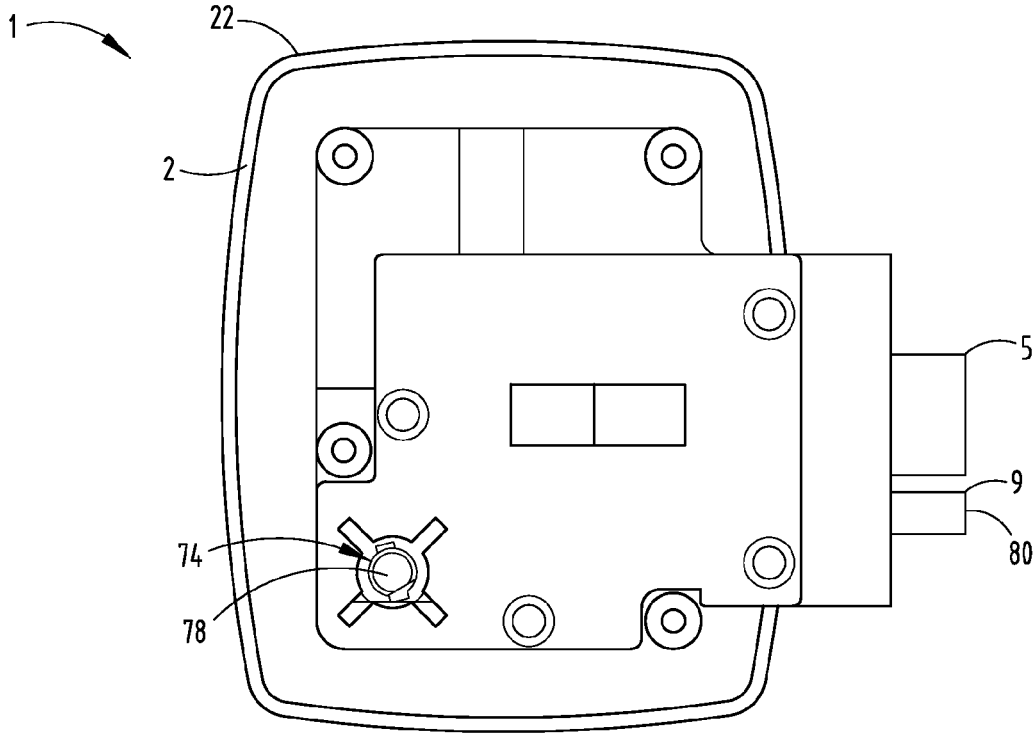
FIG. 6 is a rear elevational view of the lockable paddle handle latch assembly, wherein portions thereof have been broken away to reveal internal construction.
Figure 7:
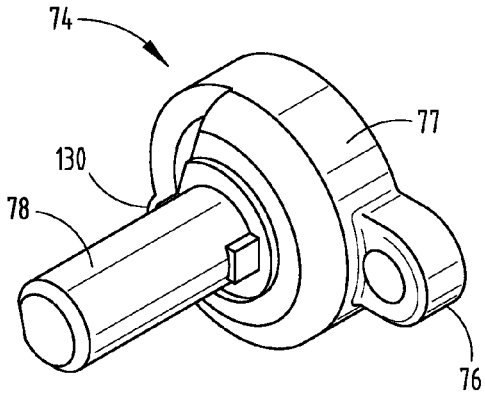
FIG. 7 is a perspective view of a deadbolt lock cam portion of the lockable paddle handle latch assembly.
Figure 8:
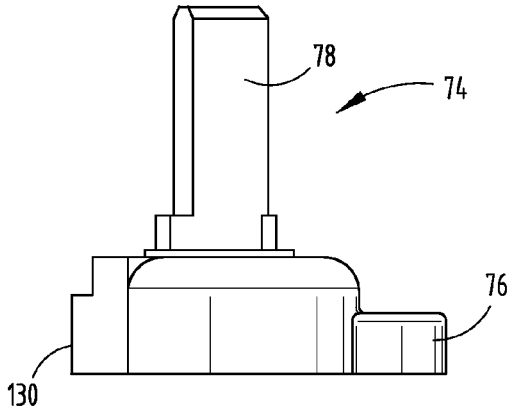
FIG. 8 is a side elevational view of the deadbolt lock cam.
Figure 9:
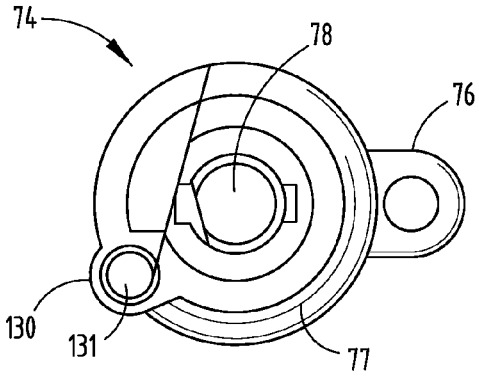
FIG. 9 is a front elevational view of the deadbolt lock cam.
Figure 10:
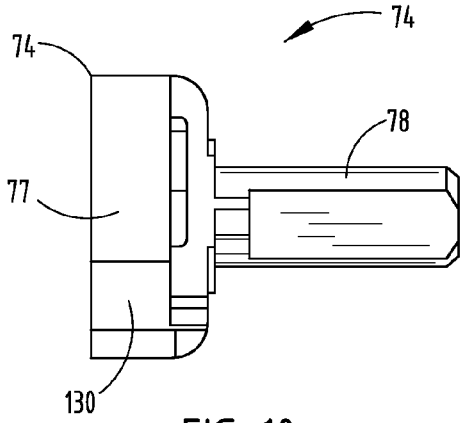
FIG. 10 is another side elevational view of the deadbolt lock cam.

The inside surface of exterior plate 22 includes a cylindrically-shaped lock boss 34 (FIG. 4), the interior of which defines lock aperture 27. The interior plate 23 of housing 2 includes a marginal portion 40 (FIG. 2) which engages the interior surface of the closure, as well as fastener bosses 41 (FIG. 2) and a lock boss 42 (FIG. 5). The rearwardmost or interior side edge 48 of interior plate 23 is contoured to define a stationary interior handle 49, which facilitates opening and closing the closure from the interior portion of the vehicle. A release lever 50 is pivotally mounted on the interior surface of interior plate 23. Release lever 50 includes a forwardly protruding actuator tab which extends through to the latch 5 to selectively shift the same to the unlatched position. An interior lock knob 52 is pivotally received in lock boss 42 on the interior plate 23, and is operably connected with the deadbolt lock 9 as described below.

In the illustrated example, the moveable key lock member 7 is in the form of a cylindrical lock plug which is received in the lock aperture 27 on the exterior housing plate 22, and is rotatably mounted in lock boss 34 for rotation between locked and unlocked positions. A multi-arm deadbolt lock cam 74 is pivotally mounted in the interior end of lock boss 34, and is operably connected with key lock member 7 for rotation therewith. The illustrated deadbolt lock cam 74 has a first crank arm 76 that is operably connected with deadbolt lock 9. As best illustrated in FIGS. 7-10, deadbolt lock cam 74 has a cylindrically-shaped base 77 with a recessed end oriented toward exterior housing plate 22 and a faced shaft 78 oriented toward interior housing plate 23. The shaft 78 on deadbolt lock cam 74 extends through the lock boss 42 in the interior housing plate 23, and the lock knob 52 is mounted on the interior end thereof, such that rotation of lock knob 52 from the interior of the vehicle rotates deadbolt lock cam 74 between the locked and unlocked positions, and simultaneously shifts the deadbolt lock 9 between the locked and unlocked positions.

The illustrated deadbolt lock 9 includes a deadbolt 80 (FIG. 12) slidably mounted in the exterior housing plate 22, and includes an outer end which extends exterior of housing 2 for engagement with an associated strike bolt assembly, and an inner end which extends interior of housing 2. A link 83 has a first end 84 thereof pivotally connected with the inner end 82 of deadbolt 80, and a second end 85 thereof pivotally connected with the first crank arm 76 of lock cam 74, such that rotation of key lock member 7 between the locked and unlocked positions longitudinally shifts the deadbolt 80 between the locked and unlocked positions.

The multi-arm lock cam 74 also includes a second crank arm 130, which is adapted for operable connection with remotely operable controller 11, which rotates lock cam 74, and shifts the deadbolt lock 80 between the locked and unlocked positions. More specifically, crank arm 130 includes an aperture 131 adjacent its outer end into which an actuator rod 133 is received, which is operably connected with remotely operable controller 11, which is typically mounted in the vehicle door. In the illustrated example, remotely operated controller 11 includes a linear actuating device in the form of a solenoid 15 or the like, which has a plunger portion 13 that shifts or reciprocates longitudinally between locked and unlocked positions in response to a remotely generated signal. The illustrated remotely operable controller 11 also includes a signal receiver portion 12 which actuates the motor upon detection of an appropriate radio frequency signal or the like. Remote actuation of the controller 11 longitudinally shifts the actuator rod 133, which in turn rotates deadbolt lock cam 74 and shifts deadbolt 80 between the locked and unlocked positions.

Figure 12:
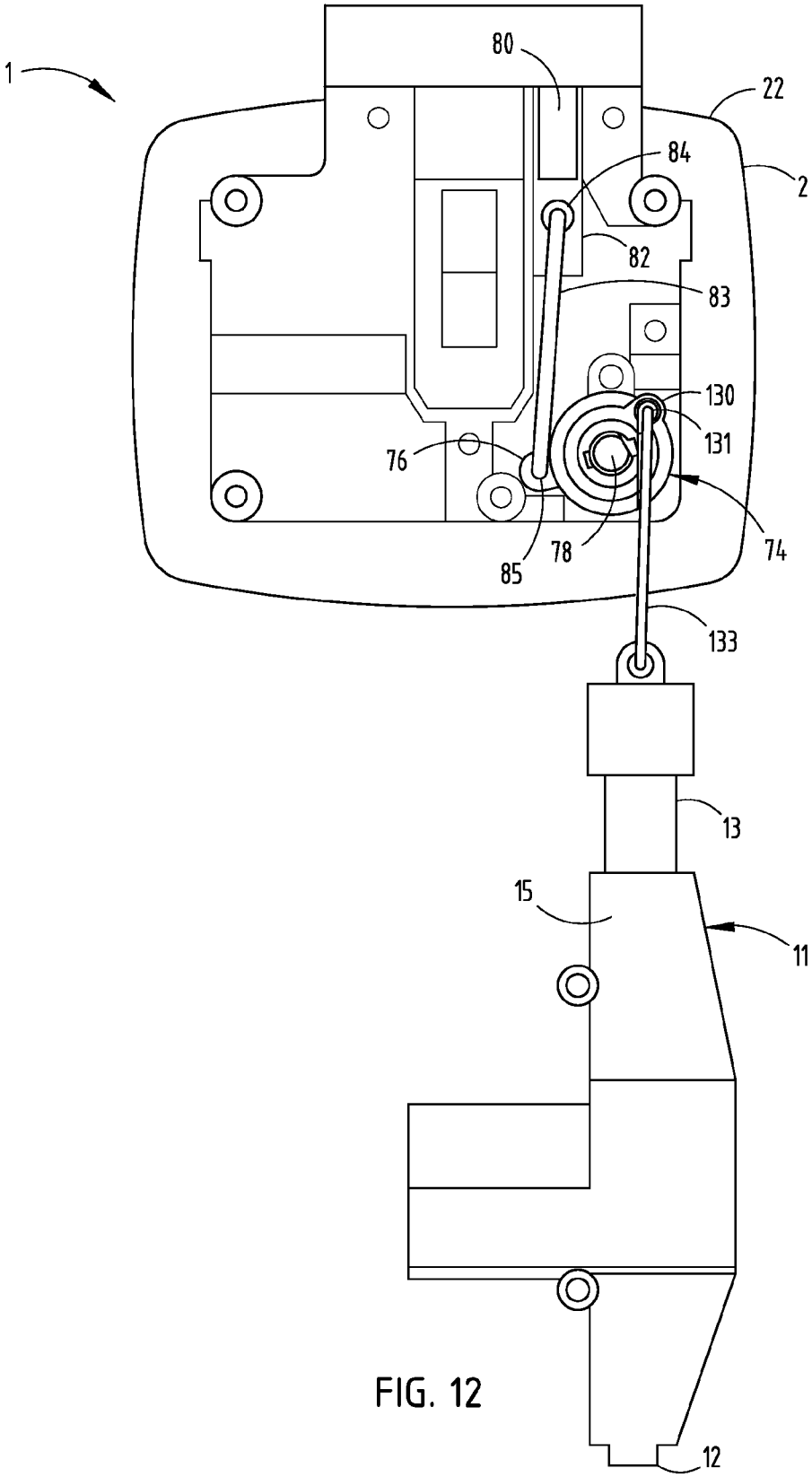
FIG. 12 is a rear elevational view of the paddle handle latch assembly with portions thereof broken away to reveal internal construction, along with the remotely operated controller.
Figure 13:
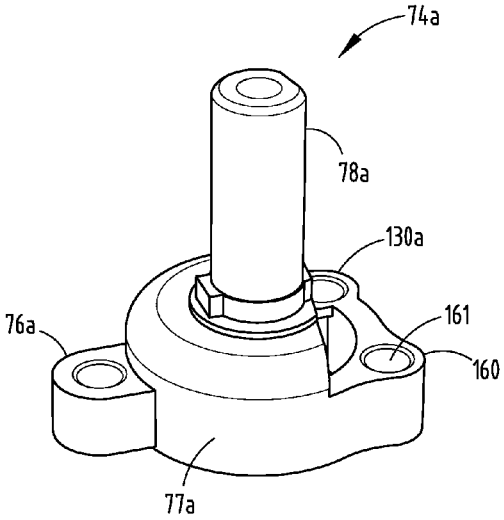
FIG. 13 is a side perspective view of an alternative embodiment of the deadbolt lock cam portion of the lockable paddle handle latch assembly.
Figure 14:
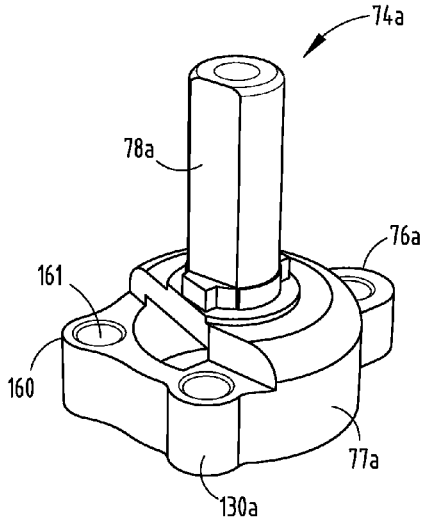
FIG. 14 is another side perspective view of the alternative embodiment of the deadbolt lock cam portion of the lockable paddle handle latch assembly.
Figure 15:
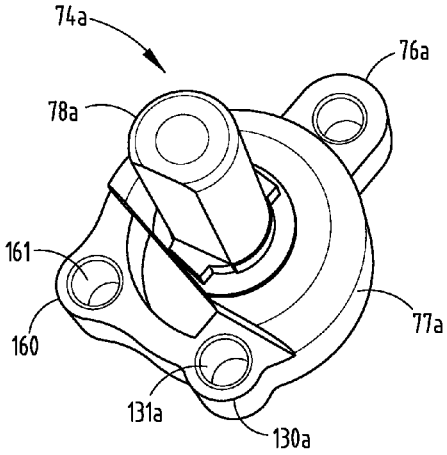
FIG. 15 is a front perspective view of the alternative embodiment of the deadbolt lock cam portion of the lockable paddle handle latch assembly.
Figure 16:
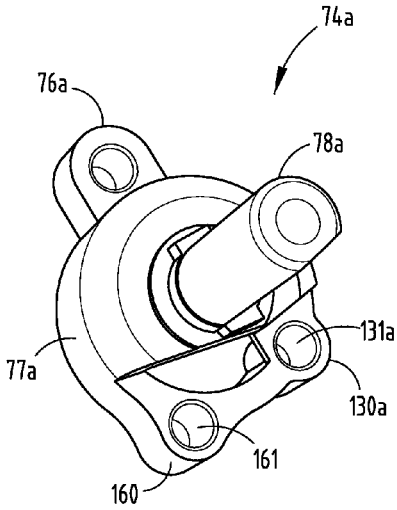
FIG. 16 is another front perspective view of the alternative embodiment of the deadbolt lock cam portion of the lockable paddle handle latch assembly.
Figure 17:
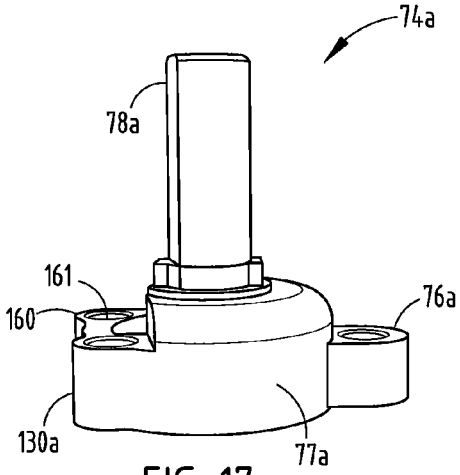
FIG. 17 is a side view of the alternative embodiment of the deadbolt lock cam portion of the lockable paddle handle latch assembly.
Figure 18:
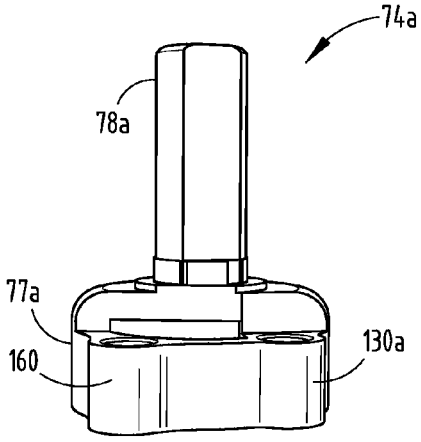
FIG. 18 is a another side view of the alternative embodiment of the deadbolt lock cam portion of the lockable paddle handle latch assembly.
Figure 19:
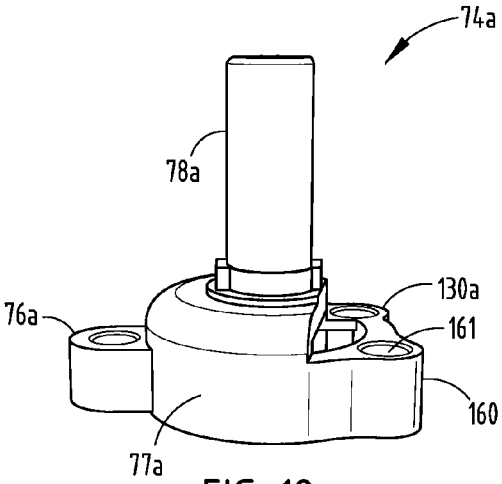
FIG. 19 is a further side view of the alternative embodiment of the deadbolt lock cam portion of the lockable paddle handle latch assembly.
Figure 20:
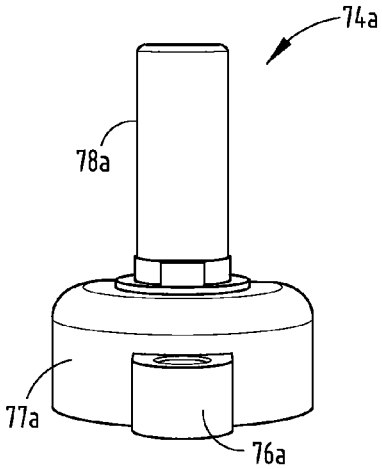
FIG. 20 is a yet another side view of the alternative embodiment of the deadbolt lock cam portion of the lockable paddle handle latch assembly.
Figure 21:
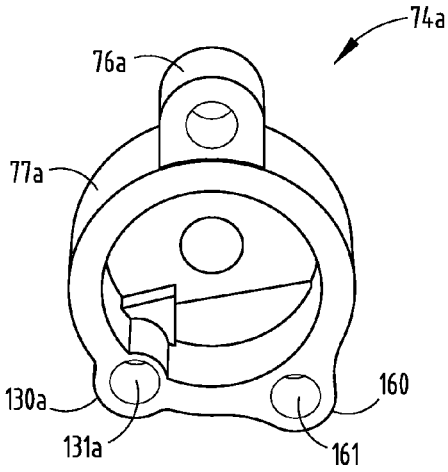
FIG. 21 is rear perspective view of the alternative embodiment of the deadbolt lock cam embodying the present invention.
Figure 22:
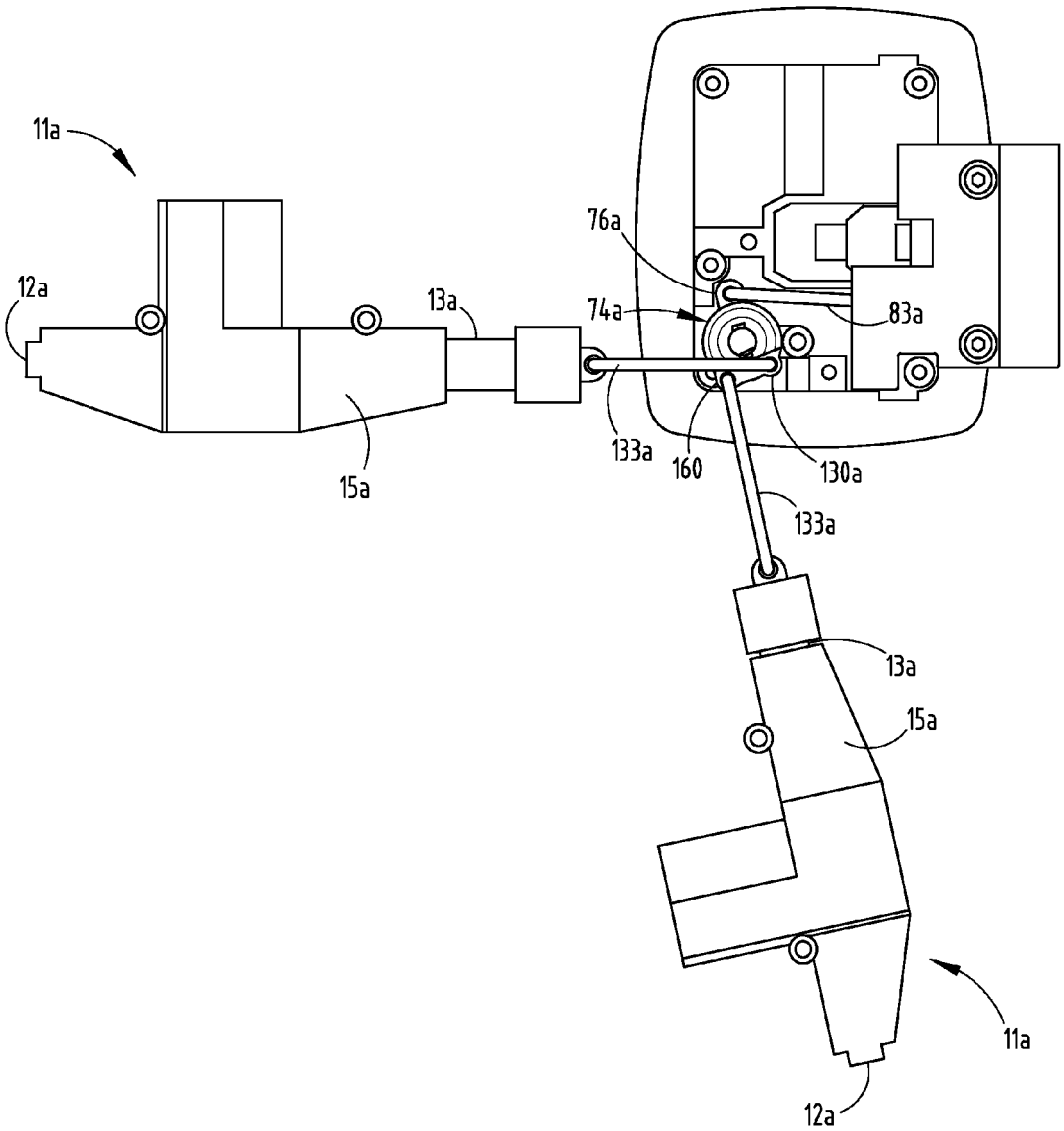
FIG. 22 is a rear elevational view of the paddle handle latch assembly employing the alternative deadbolt lock cam with portions thereof broken away to reveal internal construction, along with the remotely operated controller.

The reference numeral 74*a* generally designates an alternative embodiment of the deadbolt lock cam having a third crank arm to accommodate both vertical and horizontal actuation. Since deadbolt lock cam 74*a* is similar to the previously described deadbolt lock cam 74, similar parts appearing in FIGS. 1-12 and 13-22 are represented by the same, corresponding reference numerals, except for the suffix "a" in the numerals of the latter. With reference to FIG. 12, the panel handle latch assembly 1 is designed to be used for only horizontal actuation, and includes only two crank arms 76 and 130 respectively. In contrast, the multi-arm deadbolt lock cam 74*a* (FIGS. 13-21) includes a third crank arm 160 which facilitates both horizontal and vertical actuation of the associated panel handle latch assembly, as shown in FIG. 22. More specifically, with reference to FIGS. 13-22, the third crank arm 160 is also adapted for operable connection with the remotely operable controller 11*a*, which rotates lock cam 74*a*, and shifts the deadbolt lock 80*a* between the locked and unlocked positions.

Crank arm 160 includes an aperture 161 adjacent its outer end into which an actuator rod 133*a* is received, which is operably connected with remotely operable controller 11*a*, which is typically mounted in the vehicle door. Crank arm 160 is located circumferentially between the first and second crank arms 76*a* and 130*a*, and permits the remotely operated controller 11*a* to be oriented in a generally vertical direction, as best illustrated in the lower portion of FIG. 22. The lock cam 74*a* also permits the remotely operated controller 11*a* to be oriented in a generally horizontal direction, as best illustrated in the upper portion of FIG. 22, by using crank arm 130*a* in the manner described above. In the illustrated example, the third crank arm 160 is disposed approximately 120 to 130 degrees from the first crank arm 76*a* and approximately 60 degrees from the second crank arm 130*a*. Remote actuation of the controller 11*a* longitudinally shifts the actuator rod 133*a*, which in turn rotates deadbolt lock cam 74*a* and shifts deadbolt 80*a* between the locked and unlocked positions.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A remotely operated locking paddle handle latch assembly for closures and the like, comprising:

a housing adapted for mounting adjacent an associated closure of the type that can be shifted between an open position and a closed position;

a paddle handle pivotally mounted in an exterior portion of the housing for rotation between a retracted position and an extended position;

a latch operably connected with the paddle handle, and configured such that when the paddle handle is in the retracted position, the latch is in a latched position, wherein the closure cannot be unintentionally shifted from the closed position, and when the paddle handle is in the extended position, the latch is in an unlatched position, wherein the closure is free to be shifted from the closed position to the open position;

a key lock mounted on the exterior portion of the housing, and including a movable key lock member selectively movable between a locked position and an unlocked position, the movable key lock member comprising a cylindrical lock plug rotatably mounted in the key lock for pivoting between the locked and unlocked positions;

a deadbolt lock movably mounted in the housing for shifting between a locked position, wherein the closure is positively retained in the closed position, and an unlocked position, wherein the closure is free to be shifted between the open and closed positions; the deadbolt lock being operably connected with the movable key lock member, whereby movement of the movable key lock member between the locked and unlocked positions shifts the deadbolt lock between the locked and unlocked positions;

a multi-arm lock cam rotatably mounted in the housing and operably connected with the key lock member for rotation therewith; the lock cam having a first crank arm operably connected with the deadbolt lock, a second crank arm, and a third crank arm; and a remotely operable controller operably connected with one of either the second or the third crank arms and power shifting the deadbolt lock between the locked and unlocked positions from a remote location.

2. A remotely operated locking paddle handle latch assembly as set forth in claim 1, wherein:

the deadbolt lock includes a deadbolt having a locked and an unlocked position slidably mounted in the housing with an outer end thereof which extends exterior of the housing, an inner end thereof which extends interior of the housing, and a first link having a first end thereof pivotally connected with the inner end of the deadbolt, and a second end thereof pivotally connected with the first crank arm of the lock cam, such that rotation of the key lock member between the locked and unlocked positions longitudinally shifts the deadbolt between the locked and unlocked positions.

3. A remotely operated locking paddle handle latch assembly as set forth in claim 2, wherein the remotely operable controller is mounted horizontally relative the remotely operably locking paddle handle latch assembly and includes a horizontal link having a first end thereof pivotally connected with an actuator rod operable connected with the remotely operable controller and a second end thereof pivotally connected with the second crank arm of the lock cam, such that actuation of the remotely operable controller rotates the lock cam to longitudinally shift the deadbolt between the locked and unlocked positions.

4. A remotely operated locking paddle handle latch assembly as set forth in claim 2, wherein the remotely operable controller is mounted vertically relative the remotely operated locking paddle handle latch assembly and includes a vertical link having a first end thereof pivotally connected with an actuator rod operably connected with the remotely operable controller and a second end thereof pivotally connected with the third crank arm of the lock cam, such that actuation of the remotely operable controller rotates the lock cam to longitudinally shift the deadbolt between the locked and unlocked positions.

5. A remotely operated locking paddle handle latch assembly as set forth in claim 2, wherein the third crank arm is disposed circumferentially between the first and second crank arm.

6. A remotely operated locking paddle handle latch assembly as set forth in claim 5, wherein the third crank arm is disposed circumferentially about 120 to 130 degrees from the first crank arm and about 60 degrees from the second crank arm.

7. A remotely operated locking paddle handle latch assembly as set forth in claim 6, wherein:

the remotely operable controller includes a linear actuating device and a signal receiver which actuates the linear actuating device upon detection of a predetermined signal.

8. A remotely operated locking paddle handle latch assembly as set forth in claim 7, wherein:

the linear actuating device comprises a solenoid.

9. A remotely operated locking paddle handle latch assembly as set forth in claim 1, including:

a fixed handle operably connected with an interior portion of the housing and shaped to facilitate manually shifting the closure between the open and closed positions from an interior side of the closure.

10. A remotely operated locking paddle handle latch assembly as set forth in claim 1, including:

an interior lock actuator mounted on the interior portion of the housing, and operably connected with the lock cam for rotation therewith, such that shifting the interior lock actuator between locked and unlocked positions shifts the deadbolt lock and the latch lock between the locked and unlocked positions.

11. In a motor vehicle having a movable access closure, the improvement of a remotely operated locking paddle handle latch assembly, comprising:

a housing mounted adjacent to the closure, which is movably supported on the motor vehicle for shifting between an open position and a closed position;

a paddle handle pivotally mounted in an exterior portion of the housing for rotation between a retracted position and an extended position;

a latch operably connected with the paddle handle, and configured such that when the paddle handle is in the retracted position, the latch is in a latched position, wherein the closure cannot be unintentionally shifted from the closed position, and when the paddle handle is in the extended position, the latch is in an unlatched position, wherein the closure is free to be shifted from the closed position to the open position;

a key lock mounted on the exterior portion of the housing, and including a movable key lock member selectively movable between a locked position and an unlocked position;

a deadbolt lock having a deadbolt slidably mounted in the housing with an outer end thereof which extends exterior of the housing movably mounted in the housing for shifting between a locked position, wherein the closure is positively retained in the closed position, and an unlocked position, wherein the closure is free to be shifted between the open and closed positions, with an outer end of the deadbolt which extends exterior of the housing and an inner end of the deadbolt which extends interior of the housing operably connected with the movable key lock member;

a multi-arm lock cam rotatably mounted in the housing and operably connected with the key lock member for rotation therewith, the lock cam having a first crank arm operably connected with the deadbolt lock, a second crank arm, and a third crank arm;

a first link having a first end thereof pivotally connected with the inner end of the deadbolt, and a second end thereof pivotally connected with the first crank arm of the lock cam, such that rotation of the key lock member between the locked and unlocked positions longitudinally shifts the deadbolt between the locked and unlocked positions; and a remotely operable controller mounted proximate the remotely operated locking paddle handle latch assembly, and a second link having a first end thereof pivotally connected with an actuator rod operably connected with the remotely operable controller, and a second end thereof pivotally connected with one of either the second crank arm or the third crank arm of the lock cam.

12. The improvement of a remotely operated locking paddle handle latch assembly in a motor vehicle having a movable access closure as set forth in claim 11, wherein the remotely operable controller is mounted horizontally relative the remotely operated locking paddle handle latch assembly and the second link is positioned horizontally, whereby the second end of the second link is pivotally connected with the second crank arm of the lock cam, such that actuation of the remotely operable controller rotates the lock cam to longitudinally shift the deadbolt between the locked and unlocked positions.

13. The improvement of a remotely operated locking paddle handle latch assembly in a motor vehicle having a movable access closure as set forth in claim 11, wherein the remotely operable controller is mounted vertically relative the remotely operated locking paddle handle latch assembly and the second link is positioned vertically, whereby the second end of the second link is pivotally connected with the third crank arm of the lock cam, such that actuation of the remotely operable controller rotates the lock cam to longitudinally shift the deadbolt between the locked and unlocked positions.

* * * * *

UNITED STATES PATENT AND TRADEMARK OFFICE

CERTIFICATE OF CORRECTION

PATENT NO. : 8,393,187 B2
APPLICATION NO. : 13/368778
DATED : March 12, 2013
INVENTOR(S) : Bruce C. Bacon It is certified that error appears in the above-identified patent and that said Letters Patent is hereby corrected as shown below:

On the title page, left-hand column, Related U.S. Application Data (63),
"No. 12/369,516" should be --No. 12/396,516--;
On the title page, left-hand column, Related U.S. Application Data (63),
insert --now Pat. No. 8,347,667,-- after "Dec. 16, 2009,";

In the Specification
Col. 2, line 1,
"moveable" should be --movable--;
Col. 3, line 13,
after "is" delete "a";
Col. 3, line 22,
"is rear" should be --is a rear--;
Col. 4, line 40,
"moveable" should be --movable--;
Col. 5, line 31,
"panel handle" should be --paddle handle--;
Col. 5, line 37,
"panel handle" should be --paddle handle--;

In the Claims
Col. 6, claim 3, lines 59-60,
"operably" should be --operated--;
Col. 6, claim 3, line 62,
"operable" should be --operably--; and
Col. 7, claim 10, line 43,
after "lock" delete "and the latch lock".

Signed and Sealed this
Thirtieth Day of September, 2014

Michelle K. Lee

Michelle K. Lee
*Deputy Director of the United States Patent and Trademark Office*